US008851408B2

(12) United States Patent
Bihn

(10) Patent No.: US 8,851,408 B2
(45) Date of Patent: Oct. 7, 2014

(54) GRAIN CRUSHING APPARATUSES

(76) Inventor: John Bihn, Ft. Recovery, OH (US)

( * ) Notice: Subject to any disclaimer, the term of this patent is extended or adjusted under 35 U.S.C. 154(b) by 174 days.

(21) Appl. No.: 13/558,938

(22) Filed: Jul. 26, 2012

(65) Prior Publication Data

US 2013/0026273 A1 Jan. 31, 2013

Related U.S. Application Data

(60) Provisional application No. 61/511,602, filed on Jul. 26, 2011.

(51) Int. Cl.

| | |
|---|---|
| ***B02C 4/06*** | (2006.01) |
| ***B02C 4/38*** | (2006.01) |
| ***B02C 4/42*** | (2006.01) |
| ***B02C 4/08*** | (2006.01) |

(52) U.S. Cl.

CPC ... *B02C 4/06* (2013.01); *B02C 4/38* (2013.01); *B02C 4/42* (2013.01); *B02C 4/08* (2013.01)

USPC ..... 241/230; 241/236; 241/285.1

(58) Field of Classification Search

USPC ..... 241/236, 230, 290, 285.1

See application file for complete search history.

(56) References Cited

U.S. PATENT DOCUMENTS

| | | | | |
|---|---|---|---|---|
| 213,277 | A | | 3/1879 | Bryant |
| 2,282,718 | A | | 5/1942 | Fujioka |
| 3,208,677 | A | | 9/1965 | Hesse |
| 3,548,742 | A | | 12/1970 | Seufert et al. |
| 3,862,721 | A | | 1/1975 | Flair |
| 4,485,977 | A | * | 12/1984 | Silverthorn et al. ..... 241/230 |
| 4,608,007 | A | | 8/1986 | Wood |
| 5,154,364 | A | * | 10/1992 | Ketting ..... 241/37 |
| 5,816,511 | A | | 10/1998 | Bernardi et al. |
| 2009/0294558 | A1 | | 12/2009 | Bihn |

* cited by examiner

*Primary Examiner* — Faye Francis

(74) *Attorney, Agent, or Firm* — John D Ritchison; Ritchison Law Offices, PC

(57) ABSTRACT

Grain crushing apparatuses for processing grain are disclosed. In one embodiment, a grain crushing apparatus includes a first and second sidewall spaced apart from one another a throat dimension in a first direction, and a first and second support shaft positioned transverse to the first and sidewall. The first and second support shaft are each configured to rotate about an axis of rotation. The grain crushing apparatus also includes a first and second grain crushing roller. Each of the grain crushing rollers include a plurality of teeth extending from a root a tooth height. The first and second grain crushing rollers are intermeshed with one another such the first and second grain crushing roller are maintained at positions spaced apart from one another in a second direction normal to the first direction by an overlap distance less than the tooth height.

19 Claims, 13 Drawing Sheets

GRAIN CRUSHING APPARATUSES

CROSS-REFERENCE TO RELATED APPLICATIONS

The application claims the benefit of U.S. Provisional Patent Application Ser. No. 61/511,602 filed Jul. 26, 2011, titled "Grain Crushing Apparatus and Methods of Crushing Grains."

TECHNICAL FIELD

The present invention is generally directed to agriculture-related apparatuses, and, more particularly, to grain processing apparatuses.

BACKGROUND

Grains are processed after harvesting to convert the grains into a form that may be more easily digested by humans, livestock, and the like, than unprocessed grain. Processing the grain generally involves breaking the individual grains into smaller particles that are more easily consumed in the digestive tract of animals.

Previous techniques for processing grain include crimping, wilting, chopping, grinding, and crushing. Previous techniques, however, all have drawbacks as it relates to wear of the processing equipment, power required to process the grain, and/or uniformity of grain size. In particular, processing the grain with conventional equipment may require multiple operations to process the grain to achieve desired uniformity in the grain size.

Accordingly, new grain processing equipment and methods for processing grain with that equipment are required.

SUMMARY

These and additional objects and advantages provided by the embodiments of the present invention will be more fully understood in view of the following detailed description, in conjunction with the drawings.

In one embodiment, a grain crushing apparatus includes a first sidewall and a second sidewall spaced apart from one another a throat dimension in a first direction, and a first support shaft and a second support shaft positioned transverse to the first sidewall and the second sidewall. The first support shaft and the second support shaft are each configured to rotate about an axis of rotation and are positioned a spacing distance from one another in a second direction normal to the first direction. The grain crushing apparatus also includes a first grain crushing roller and a second grain crushing roller. Each of the grain crushing rollers include a plurality of teeth extending from a root a tooth height. The first grain crushing roller is coupled to the first support shaft and the second grain crushing roller is coupled to the second support shaft. The first grain crushing roller and the second grain crushing roller are intermeshed with one another such the first grain crushing roller and the second grain crushing roller are maintained at positions spaced apart from one another in the second direction by an overlap distance less than the tooth height.

In another embodiment, a grain crushing apparatus includes a mill body having a first sidewall and a second sidewall spaced apart from one another a throat dimension in a first direction, where at least one of the first sidewall or the second sidewall includes a clearance opening. The grain crushing apparatus also includes a roller carrier assembly that is selectively extendible from the clearance opening in the mill body. The roller carrier assembly includes a first mount plate and a second mount plate spaced apart from one another in the first direction, a first support shaft and a second support shaft positioned transverse to the first mount plate and the second mount plate. The first support shaft and the second support shaft are each configured to rotate about an axis of rotation and are spaced a spacing distance from one another. The roller carrier assembly also includes a first grain crushing roller and a second grain crushing roller, where each of the grain crushing rollers includes a plurality of teeth extending from a root a tooth height. The first grain crushing roller is coupled to the first support shaft and the second grain crushing roller is coupled to the second support shaft, and the first grain crushing roller and the second grain crushing roller are intermeshed with one another such that the first grain crushing roller and the second grain crushing roller are maintained at a position spaced apart from one another by an overlap distance less than the tooth height.

In yet another embodiment, a grain crushing apparatus kit includes a mill body having a first sidewall and a second sidewall spaced apart from one another a throat dimension in a first direction. The grain crushing apparatus kit also includes a roller carrier assembly that is selectively extendible from the mill body. The roller carrier assembly includes a first mount plate and a second mount plate spaced apart from another in the first direction, and a first support shaft and a second support shaft positioned transverse to the first mount plate and the second mount plate. The first support shaft and the second support shaft each configured to rotate about an axis of rotation and are spaced a spacing distance from one another. The grain crushing apparatus kit also includes plurality of grain crushing rollers each having a plurality of teeth extending from a root a tooth height. A first grain crushing roller is adapted to be selectively coupled to the first support shaft and a second grain crushing roller is adapted to be selectively coupled to the second support shaft, where the first grain crushing roller and the second grain crushing roller are intermeshed with one another such that the first grain crushing roller and the second grain crushing roller are maintained at a position spaced apart from one another by an overlap distance less than the tooth height. At least two of the grain crushing rollers have outer diameters different from one another such that the overlap distance between the first grain crushing roller and the second grain crushing roller is adjustable.

BRIEF DESCRIPTION OF THE DRAWINGS

The following detailed description of specific embodiments of the present invention can be best understood when read in conjunction with the drawings enclosed herewith.

Figure 1:
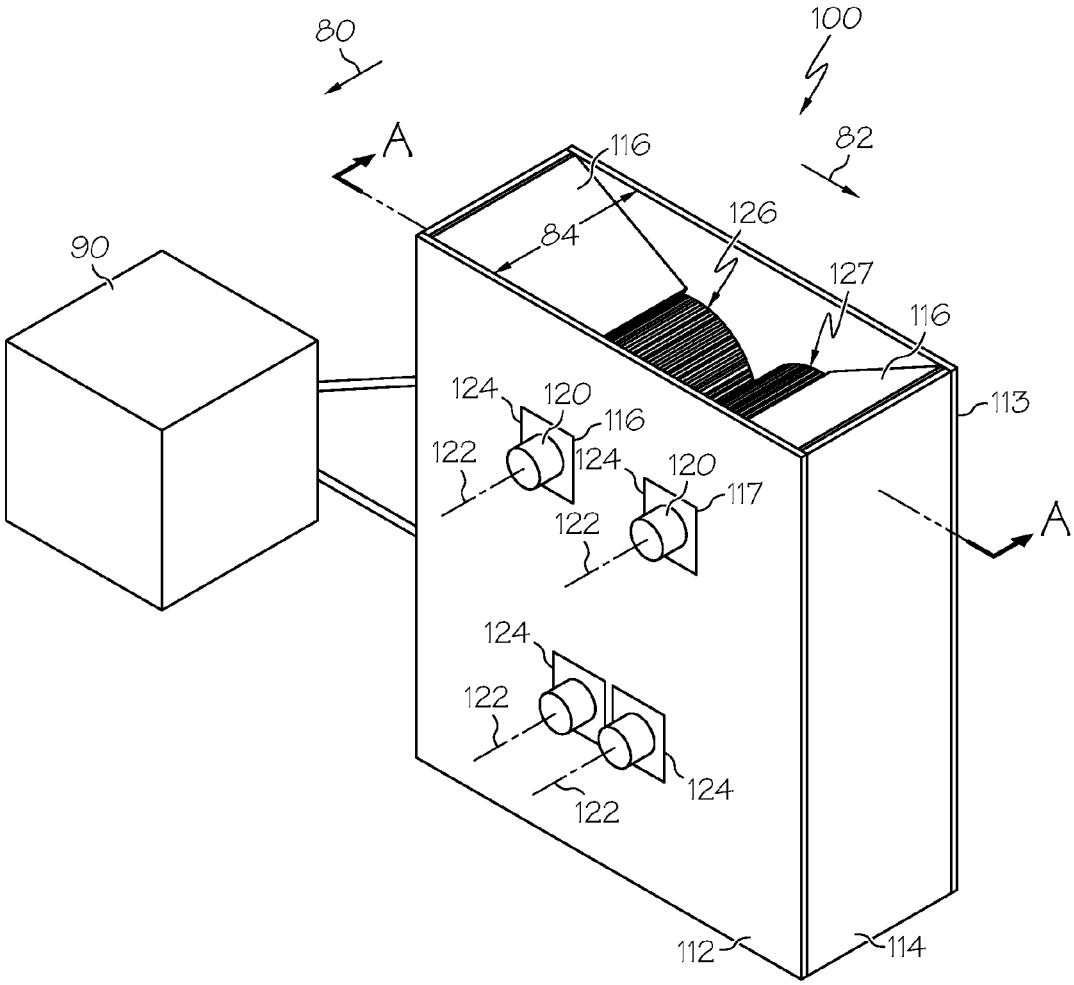
FIG. 1 is a side perspective view of a grain crushing apparatus including locator blocks according to one or more embodiments of the present disclosure.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION

Embodiments of the present invention are directed to grain crushing apparatuses for processing grain from whole kernels into smaller particulates, including processing whole grains into meal or flour. The grain crushing apparatuses include a mill body having a first sidewall and a second sidewall spaced apart from one another in a first direction, a first support shaft and a second support shaft positioned transverse to the first sidewall and the second sidewall. The first support shaft and the second support shaft are each configured to rotate about an axis of rotation and are rigidly spaced a spacing distance apart from one another. The grain crushing apparatus also includes a first grain crushing roller and a second grain crushing roller, each including a plurality of teeth extending from a root a tooth height, where the respective grain crushing rollers are coupled to the support shafts such that the first and second grain crushing rollers are intermeshed with one another and are maintained at a position spaced apart from one another by an overlap distance less than the tooth height. The grain crushing rollers counter rotate relative to one another such that grain introduced between the sidewalls proximate to the grain crushing rollers is ingested by the grain crushing rollers and crushed by the interaction between the intermeshed teeth of the grain crushing rollers. Control of the overlap distance between the adjacent grain crushing rollers allows for the consistency of the crushed grain particles to be controlled.

One embodiment of a grain crushing apparatus 100 is depicted in FIG. 1. The grain crushing apparatus 100 includes mill body 102 having a first sidewall 112 and a second sidewall 113 that are spaced apart from one another in a first direction 80. The spacing between the first sidewall 112 and the second sidewall 113 define a throat dimension 84 of the grain crushing apparatus 100. The mill body 102 also includes endwalls 106 positioned proximate to the ends of the first and second sidewalls 112, 113. The grain crushing apparatus 100 also includes at least a first support shaft 120 and a second support shaft 121 that are positioned transverse to the first and second sidewalls 112, 113 and extend through the first and second sidewalls 112, 113. Each of the first and second support shafts 120, 121 have an axis of rotation 122 around which the first or second support shaft 120, 121 rotates. The first support shaft 120 and the second support shaft 121 are spaced apart from one another a spacing distance 86 in the second direction 82 that is normal to the first direction 80. In the embodiment depicted in FIG. 1, the axes of rotation 122 of the first and second support shafts 120, 121 are generally perpendicular to the first and second sidewalls 112, 113 of the grain crushing apparatus 100.

The grain crushing apparatus 100 also includes a first grain crushing roller 126 coupled to the first support shaft 120 and a second grain crushing roller 127 coupled to the second support shaft 121. Each of the first and second grain crushing rollers 126, 127 are installed into the grain crushing apparatus 100 such that the grain crushing rollers 126, 127 are positioned proximate to an opening 104 defined by the first and second sidewalls 112, 113 having the throat dimension 84. In the embodiment depicted in FIGS. 1 and 2, the grain crushing apparatus 100 includes a plurality of locator blocks 124 that are selectively coupled to the first and second sidewalls 112, 113 of the grain crushing apparatus 100. The first sidewall 112 of the grain crushing apparatus 100 includes a first cavity 114 and the second sidewall 113 includes a second cavity 115 positioned opposite the first cavity 114 into which the locator blocks 124 are positioned. Each of the first and second cavities 114, 115 include a respective first and second datum face 116, 117.

Figure 2:
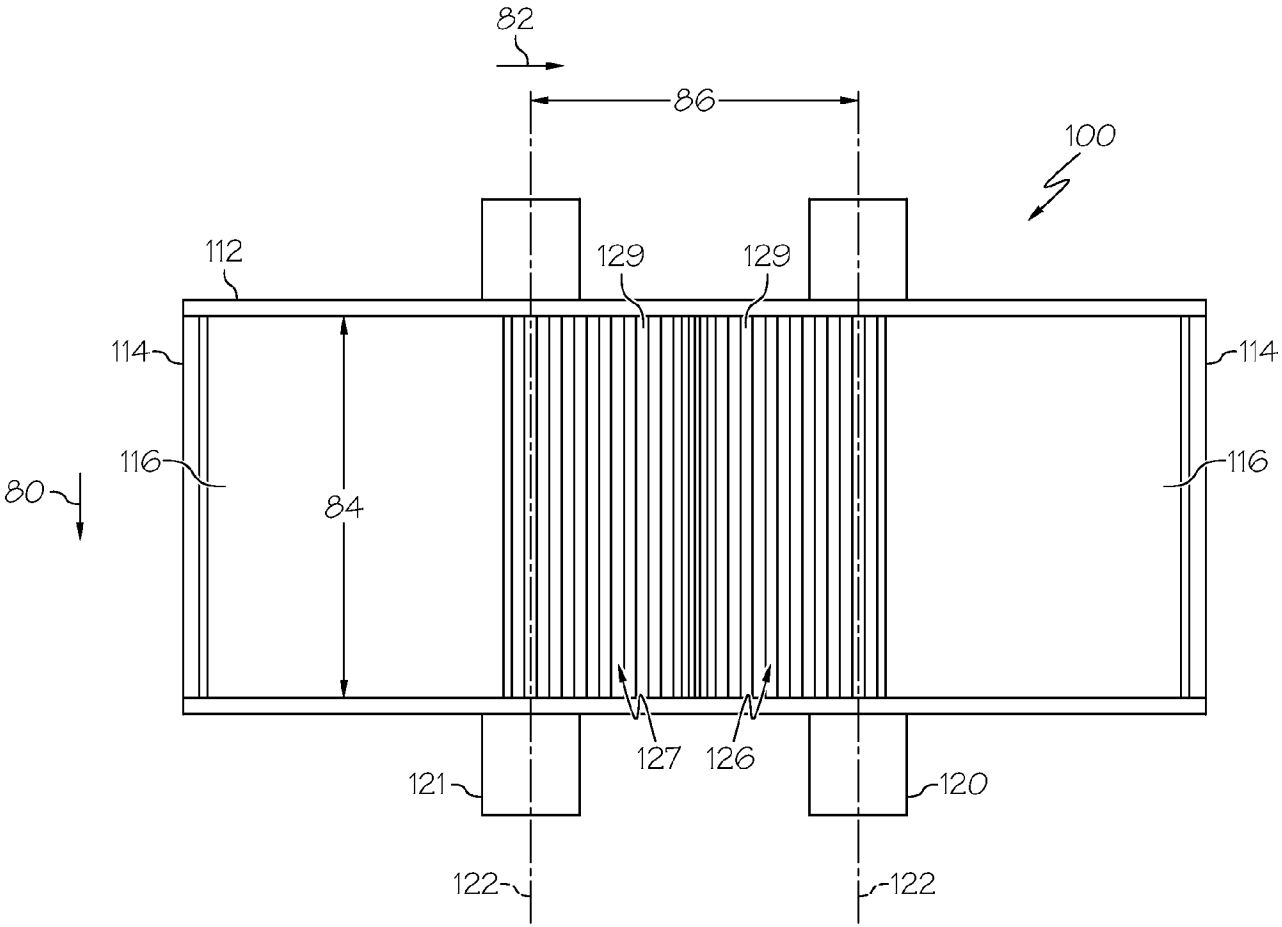
FIG. 2 is a top view of a grain crushing apparatus including locator blocks according to one or more embodiments of the present disclosure.

Referring now to FIG. 2, a top view of the grain crushing apparatus 100 is depicted. Grain kernels, including, but not limited to, wheat, corn, rice, barley, and oats, that are introduced to the grain crushing apparatus 100 are directed towards the first and second grain crushing rollers 126, 127 by the guide plates 108. As the grain crushing rollers 126 rotate towards one another, the individual teeth 129 on the grain crushing rollers 126 intermesh with one another and draw the grain kernels through the grain crushing apparatus 100. As the individual teeth 129 on adjacent first and second grain crushing rollers 126, 127 approach the minimum distance between one another, the spacing between teeth 129 on adjacent first and second grain crushing rollers 126, 127 crush the grain into particles. The size of the particle produced by the first and second grain crushing rollers 126, 127 is determined by the spacing between the axes of rotation 122 of the first and second grain crushing rollers 126, 127.

Figure 4:
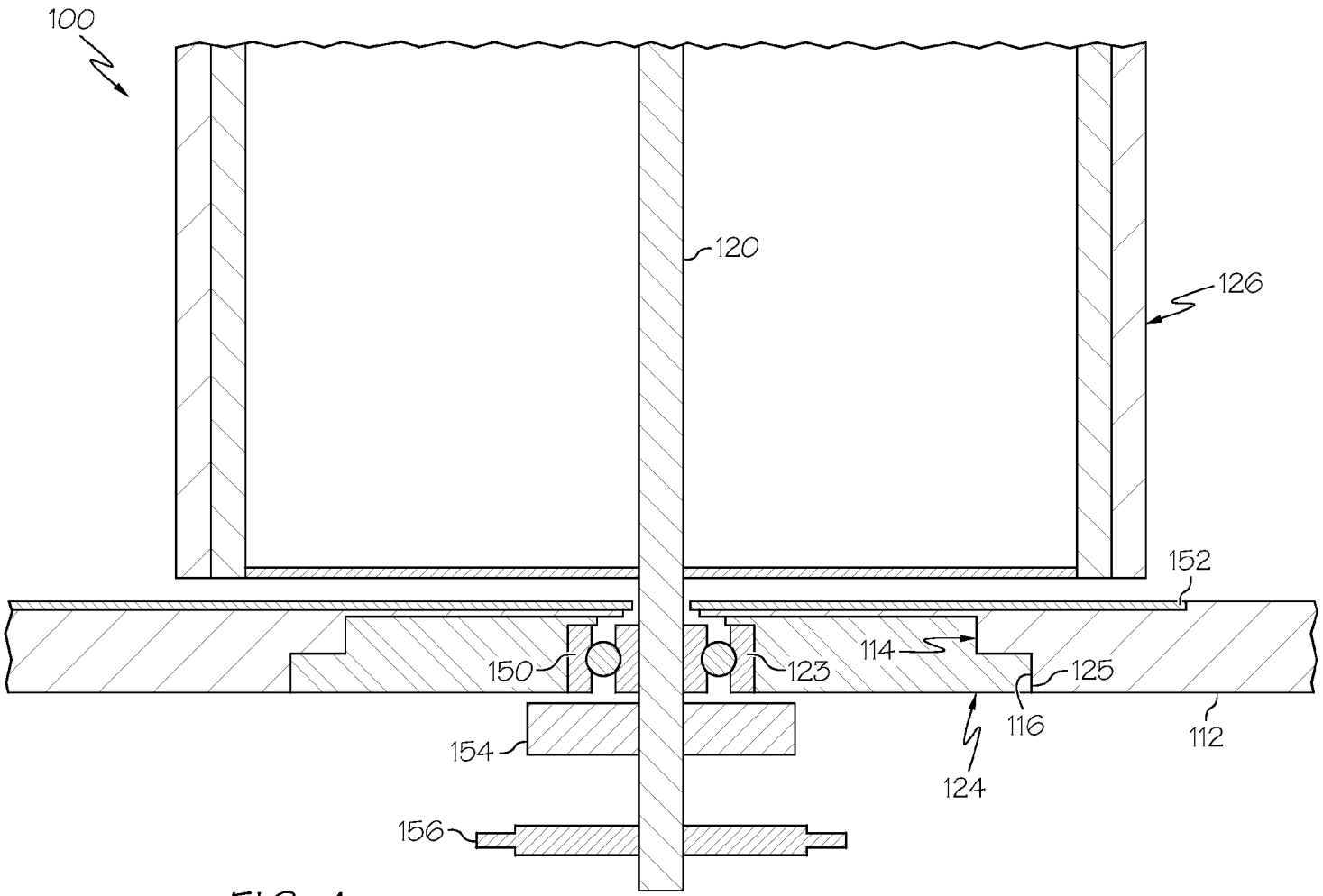
FIG. 4 is a sectional top view of a grain crushing apparatus according to one or more embodiments of the present disclosure depicted along line B-B of FIG. 6.

Referring now to FIG. 4, a generic version of the interface between the locator block 124 and one of the sidewalls 112 is depicted. The locator blocks 124 each include bore diameters 123. When the grain crushing rollers 126, 127 are installed into the grain crushing apparatus 100, the support shafts 120 pass through the bore diameters 123 of the locator blocks 124. The locator blocks 124 control the location and the spacing of the first and second support shafts 120, 121 and therefore, the control the spacing between the grain crushing rollers 126 themselves. The locator blocks 124 rigidly position the support shafts 120, and therefore the grain crushing rollers 126, such that the position of adjacent grain crushing rollers 126 is maintained throughout a grain processing operation. In some embodiments, the position of the locator blocks 124 within the first and second cavities 114, 115 are controlled by contacting the respective datum faces 116, 117 of the first and second cavities 114, 115, The locator blocks 124 depicted in FIG. 4 are removable and replaceable, such that a locator block 124 having a different location of the bore diameter 123 relative to the respective datum face 116, 117 can be exchanged into the first and second cavities 114, 115 of the first and second sidewall 112, 113, respectively. By exchanging locators block 124 having different relative positioning of the bore diameters 123, the spacing distance 86 between the grain crushing rollers 126 can be adjusted to meet the requirements of a particular grain processing operation, while otherwise maintaining the rigidity of the positioning of the grain crushing rollers 126.

Still referring to FIG. 4, the grain crushing apparatus 100 includes the sidewall 112 and the roller 126 coupled to a support shaft 120 having an axis of rotation 122 generally perpendicular to the sidewall 112. While specific mention is made herein to a single sidewall 112, support shaft 120, cavity 114, locator block 124, and datum face 117, it should be understood that grain crushing apparatuses 100 according to the present disclosure may include a plurality of such items arrange proximate to each of the grain crushing rollers 126, 127. The locator block 124 is placed within a cavity 114 in the first sidewall 112. A bore diameter 123 passes through the locator block 124. A bearing, for example a roller 126 element bearing, is inserted into the bore diameter 123. The support shaft 120, onto which the roller 126 is coupled, is inserted through the inner race of the bearing. Thus, relative positioning of the bore diameter 123 along the locator block 124 determines the position of the roller 126 along the second direction 82 in the grain crushing apparatus 100. A clamp 154 is coupled to the support shaft 120 outside of the first sidewall 112 of the grain crushing apparatus 100, which limits axial motion of the support shaft 120, and therefore the roller 126 in the direction of the axis of rotation 122. A drive sprocket 156 is coupled to the support shaft 120. The drive sprocket 156 for the driven roller 126 is coupled to a driving mechanism 90 through the drive belt or chain, as will be discussed below.

As depicted in FIG. 4, the locator blocks 124 include a flange 125 that mates with the corresponding cavity 114 in the sidewall 112. The locator block 124 and the corresponding cavity 114 in the sidewall 112 may include features that allow the locator block 124 to be installed in only one position and one orientation relative to the sidewalls 112. Such features, such as the flange 125, that control the position and orientation of the locator block 124 within the cavity 114 of the sidewall 112, prevent a user from assembling the grain crushing apparatus 100 incorrectly. These features also allow a user to easily and reliably interchange locator blocks 124 having bore diameters 123 located at different positions. Other "lock-and-key" features that ensure proper assembly of the locator blocks 124 along the sidewalls 112 of the grain crushing apparatus 100 are contemplated.

By supplying locator blocks 124 having bore diameters 123 that are positioned to provide variation in the spacing, a grain crushing apparatus 100 can be configured to grind grain to a variety of final particle size. The locator blocks 124 allow for adjustability, while maintaining rigidity in the spacing between the first and second grain crushing rollers 126, 127 as depicted in FIG. 2. Thus, a set of locator blocks 124 may be supplied with a grain crushing apparatus 100 as a kit, such that an end user can assemble the grain crushing apparatus 100 such that the first and second grain crushing rollers 126, 127 are positioned relative to one another with the appropriate spacing to deliver the required final particle size of the grain.

Surface plates 152 are coupled to the sidewalls 112 of the grain crushing apparatus 100 and positioned adjacent to the grain crushing roller 126. The surface plates 152 prevent direct contact between the grain crushing rollers 126 and either of the locator blocks 124 or the sidewalls 112 of the grain crushing apparatus 100. The shear plate may be made of a material that has a low sliding coefficient of friction with steel, for example bearing bronze.

Various seals (not shown in FIG. 4) may be located adjacent to the locator blocks 124 and the support shafts 120. The seals prevent grain from being force away from the working surfaces of the grain crushing rollers 126 and from being introduced to the bearings 150. The seals may also prevent lubricants or other external debris from being introduced to the internal components of the grain crushing apparatus 100, which may contaminate the grain processed through the grain crushing apparatus 100.

Figure 3:
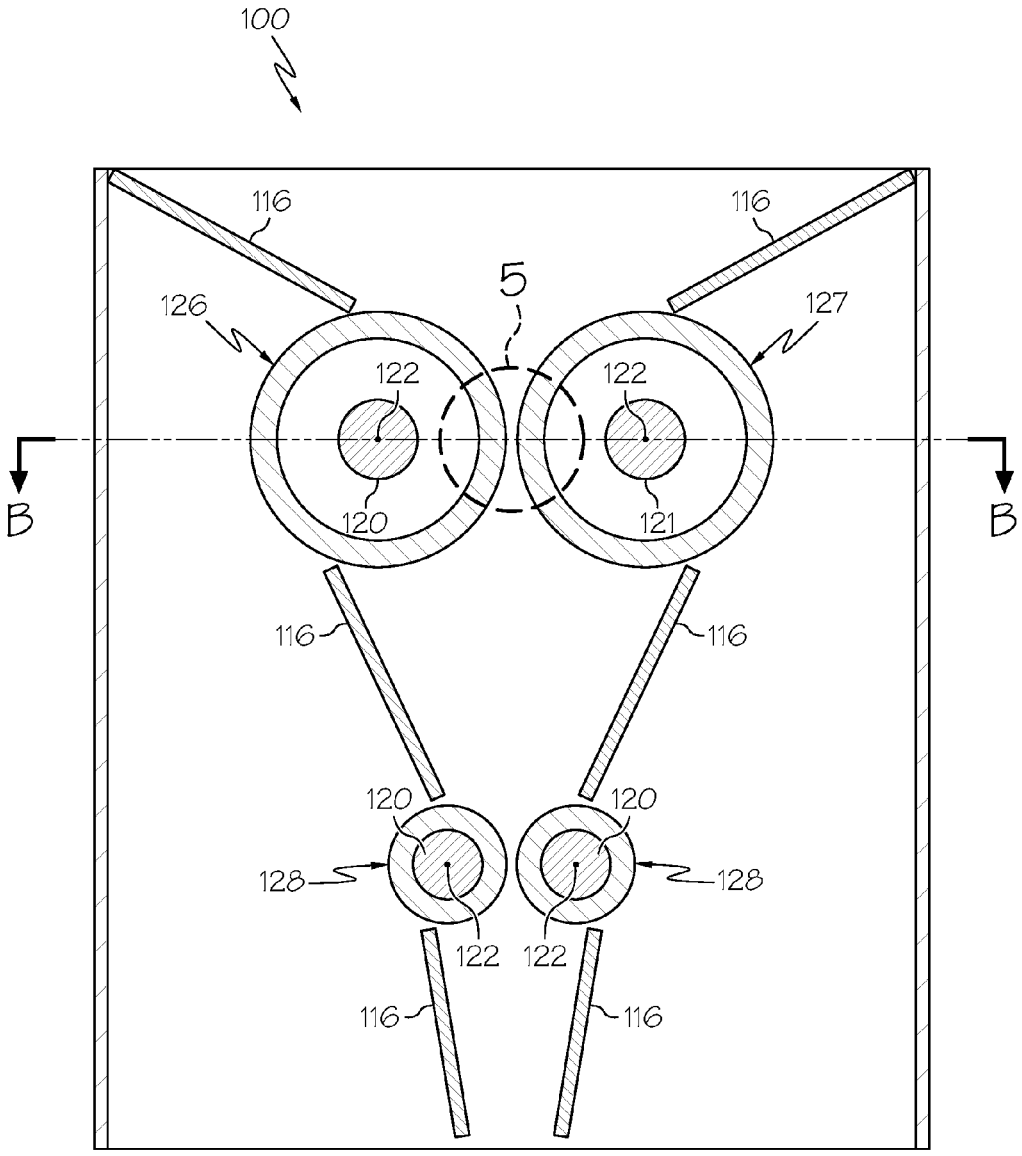
FIG. 3 is a sectional side view of a grain crushing apparatus according to one or more embodiments of the present disclosure depicted along line A-A of FIG. 1.
Figure 5:
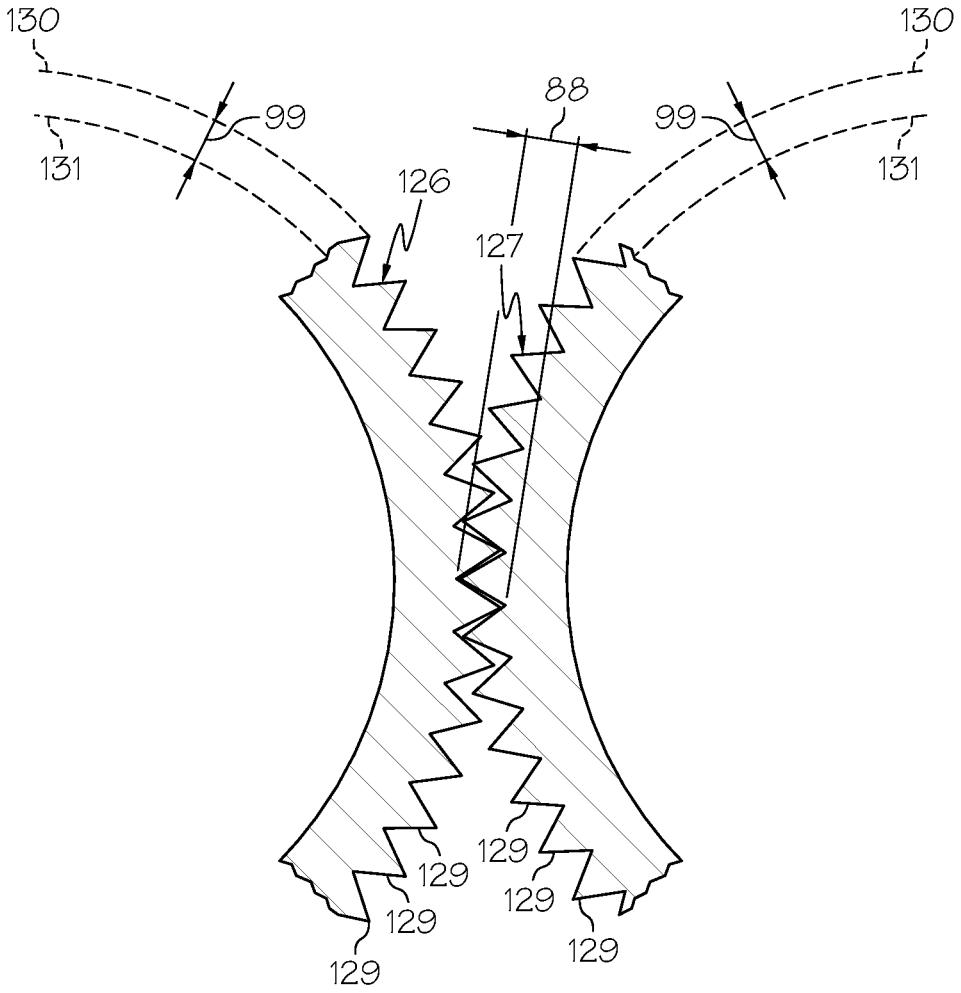
FIG. 5 is a detail view of the grain crushing apparatus of a grain crushing apparatus according to one or more embodiments of the present disclosure depicted in FIG. 2.

The components of an embodiment of the grain crushing apparatus 100 are further depicted in FIG. 3, which is shown in greater detail in FIG. 5. A set of first and second grain crushing rollers 126, 127 are positioned spaced relative to one another such that the axes of rotation 122 of the first and second support shafts 120, 121, and therefore the first and second grain crushing rollers 126, 127, is generally perpendicular to the first and second sidewalls 112, 113. Referring to FIG. 5, the teeth 129 of the first and second grain crushing rollers 126, 127 project away from a root diameter 131 of the first and second grain crushing rollers 126, 127, towards an outer diameter 130. The first and second grain crushing rollers 126, 127 may be manufactured using a variety of techniques including, but not limited to, broaching, hobbing, and/or electric discharge machining. The distance between the outer diameter 130 of the teeth 129 and the root diameter 131 of the first and second grain crushing rollers 126, 127 is defined as the tooth height 99. The grain crushing rollers 126 are positioned such that the teeth 129 of the corresponding first and second grain crushing rollers 126, 127 intermesh with one another. The first and second grain crushing rollers 126, 127 are spaced apart from one another a spacing distance 86 (i.e., the distance between the respective axis of rotation 122) that provides clearance between teeth 129 of the adjacent first and second grain crushing rollers 126, 127. The distance between the teeth 129 is controlled such that a minimum spacing is maintained between the teeth 129. The teeth 129 of the first and second grain crushing rollers 126, 127 are maintained at a position spaced apart from one another an overlap distance 88 (i.e., the distance between nearest teeth 129 of adjacent grain crushing rollers 126, 127) that is less than the tooth height 99. Therefore, the outer diameter 130 of the first and second grain crushing rollers 126, 127 intersect one another, while the root diameters 131 of the first and second grain crushing rollers 126, 127 do not intersect one another.

The teeth 129 (or lobes) of the first and second grain crushing rollers 126, 127 may take a variety of shapes, including having straight cut teeth 129 (i.e., a spur gear), having a triangular cross-sectional shape, or having helical shaped lobes. The first and second grain crushing rollers 126, 127 may be installed into the space between the sidewalls 112 of the grain crushing apparatus 100 such that the teeth 129 of the rolls at least partially intermesh with one another. The first and second grain crushing rollers 126, 127 may be spaced apart from one another such that there is not complete engagement of the intermeshed teeth 129 of adjacent first and second grain crushing rollers 126, 127, such that is some clearance between the outer diameter 130 of one of the first and second grain crushing rollers 126, 127 and the root diameter 131 of the opposite of the first and second grain crushing rollers 126, 127. This clearance distance may be set by the combination of the root diameter 131 and outer diameter 130 of each of the first and second grain crushing rollers 126, 127 and the distance between the support shafts 120, 121 (i.e., the spacing distance 86) about which the first and second grain crushing rollers 126, 127 are adapted to rotate.

Referring again to FIG. 3, in some embodiments of the grain crushing apparatus 100, a set of finishing rollers 128 may be positioned generally perpendicular to the sidewalls 112 at a location below the first and second grain crushing rollers 126, 127. Similar to the first and second grain crushing rollers 126, 127, the finishing rollers 128 are positioned on support shafts 120, 121. These support shafts 120, 121 upon which the finishing rollers 128 are positioned by the locator blocks 124. Thus, similar to the first and second grain crushing rollers 126, 127 discussed hereinabove, spacing between the finishing rollers 128 is controlled by the features of the locator blocks 124 and the location of the locator blocks 124 along the first and second sidewalls 112, 113 of the grain crushing apparatus 100.

The finishing rollers 128 may include a variety of surfaces finishes around the circumference of the finishing rollers 128 that act with the grain processed through the first and second grain crushing rollers 126, 127 to modify the appearance of the grain. In one embodiment, the finishing rollers 128 include a knurled surface around the circumference. Adjacent finishing rollers 128 having a knurled surface are separated from one another a fixed distance such that the finishing rollers 128 do not contact one another. Grain processed through the first and second grain crushing rollers 126, 127 is introduced to the finishing rollers 128, which apply force to the grain to separate components of the grain that have previously been crushed by passing through the first and second grain crushing rollers 126, 127. The finishing rollers 128 may improve the appearance of the grain by replicating flour or meal produced by other processing techniques. Providing a grain with acceptable appearance may be important to satisfy purchasers of the processed grain.

The grain crushing apparatus 100 also includes guide plates 108 that are inserted into the sidewalls 112. The guide plates 108 direct grain towards the first and second grain crushing rollers 126, 127 or the finishing rollers 128 for processing. The guide plates 108 may assist with collection of grain that has been processed through the first and second grain crushing rollers 126, 127 and finishing rollers 128 by limiting the area in which the grain may be ejected from the first and second grain crushing rollers 126, 127 and the finishing rollers 128. This may improve handling of the processed grain through the grain crushing apparatus 100 and increase cleanliness of operation by reducing the amount of grain that is diverted away from the desired processing path through the grain crushing apparatus 100.

Figure 6:
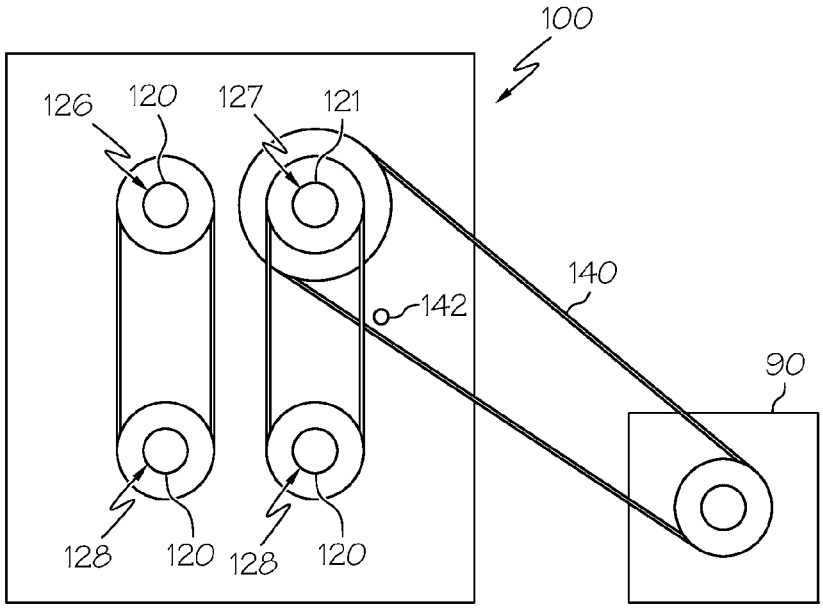
FIG. 6 is a side view of a grain crushing apparatus according to one or more embodiments of the present disclosure.

The grain crushing apparatus 100 depicted in FIG. 6 includes a driving mechanism 90 coupled to at least one of the support shafts 120 to which one of the first or second grain crushing roller 126, 127 is coupled. The driving mechanism 90 is coupled to the support shaft 120 through a flexible drive member, for example, a belt 140 or a chain. As the teeth 129 of adjacent first and second grain crushing rollers 126, 127 mesh with one another, only one of a set of adjacent first and second grain crushing rollers 126, 127 needs to be coupled to the driving mechanism 90. As depicted, the second grain crushing roller 127 that is coupled to the driving mechanism 90 applies a force to the first grain crushing roller 126, which is not coupled to the driving mechanism 90 through the interaction between the intermeshed teeth 129 of the first and second grain crushing rollers 126, 127. As the second grain crushing roller 127 rotates, the teeth 129 of the second grain crushing roller 127 contact the teeth 129 of the first grain crushing roller 126, causing the first grain crushing roller 126 to rotate. The first and second grain crushing rollers 126, 127 may rotate at a speed that corresponds to the ratio of teeth 129 on the first and second grain crushing rollers 126, 127.

The grain crushing apparatus 100 may include a tensioning mechanism 142, for example an idler gear or pulley, whose position is adjusted to provide the desired tension on the belt 140. As depicted in FIG. 6, the finishing rollers 128 are coupled to the first and second grain crushing rollers 126, 127, such that the driving mechanism 90, directly or indirectly, applies torque to all of the support shafts 120, 121 about which the first and second grain crushing rollers 126, 127 and/or the finishing rollers 128 rotate. The feed rate at which the first and second grain crushing rollers 126, 127 ingest grain is determined by the diameter of the first and second grain crushing rollers 126, 127 and the speed at which the first and second grain crushing rollers 126, 127 rotate. Similarly, the feed rate of the finishing rollers 128 is determined by the diameter of the finishing rollers 128 and the speed at which the finishing rollers 128 rotate. The nominal feed rates of the first and second grain crushing rollers 126, 127 and the finishing rollers 128 may be set such that the nominal feed rate of the finishing rollers 128 exceeds the nominal feed rate of the first and second grain crushing rollers 126, 127, such that a significant volume of grain does not build up inside the grain crushing apparatus 100 between the first and second grain crushing rollers 126, 127 and the finishing rollers 128.

Figure 7:
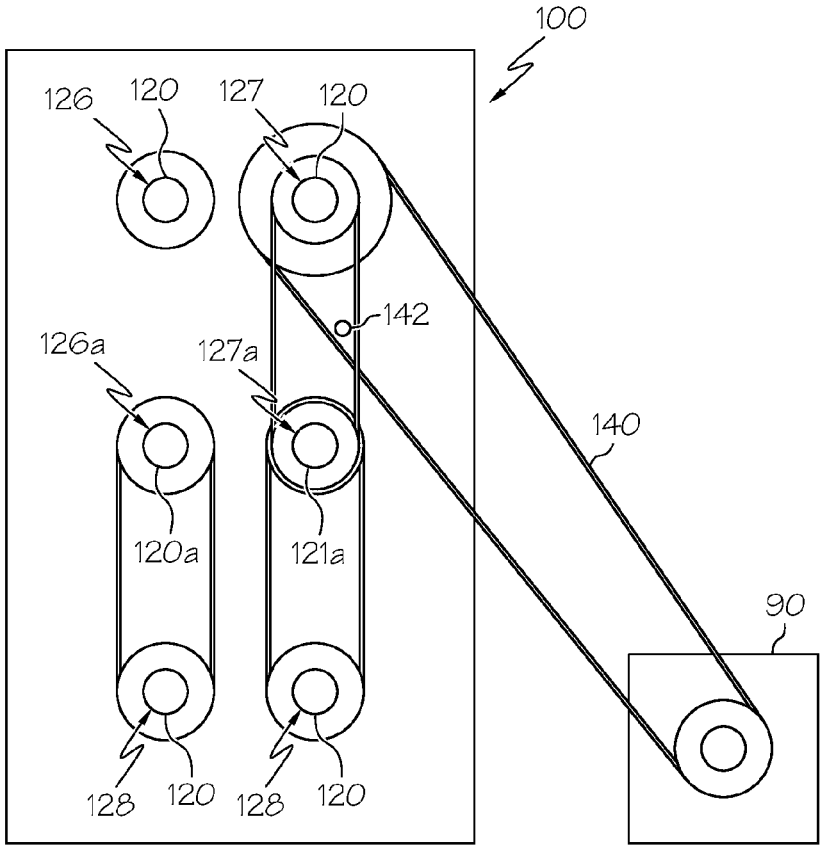
FIG. 7 is a side view of a grain crushing apparatus according to one or more embodiments of the present disclosure.

Without being bound by theory, processing grain into smaller particle sizes (i.e., small average micron) requires more power as the size of the particles decrease. More work is required to be input to the grain crushing apparatus 100 to crush the grain into smaller particles. To process the grain to smaller particle sizes, a more powerful driving mechanism 90 may be employed that is capable of applying greater torque to the first and second grain crushing rollers 126, 127. Alternatively, or in addition, a second set of first and second grain crushing rollers 126*a*, 127*a* may be installed into the grain crushing apparatus 100, as depicted in FIG. 7. The use of a second set of grain crushing rollers 127 in combination with the grain crushing rollers 126*a*, 126*b* may decrease the total power required to be input to the grain crushing apparatus 100 in order to process the grain to the desired final particle size. Similar to the discussion hereinabove with regard to FIG. 6, the feed rates of the grain crushing apparatus 100 components may be set such that the finishing rollers 128 have a nominal feed rate greater than the second set of first and second grain crushing rollers 126*a*, 127*a*, which themselves nominal feed rate greater than the first set of grain crushing rollers 126, 127.

Figure 8:
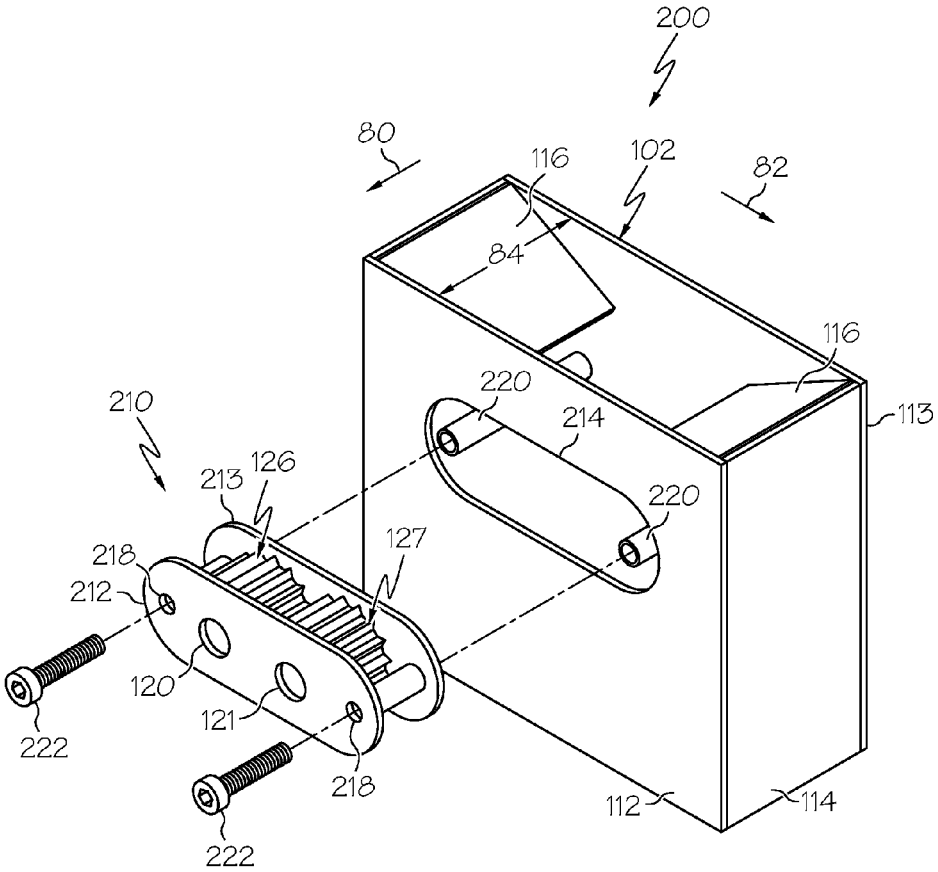
FIG. 8 is an exploded side perspective view of a grain crushing apparatus including a roller carrier assembly according to one or more embodiments of the present disclosure.
Figure 9:
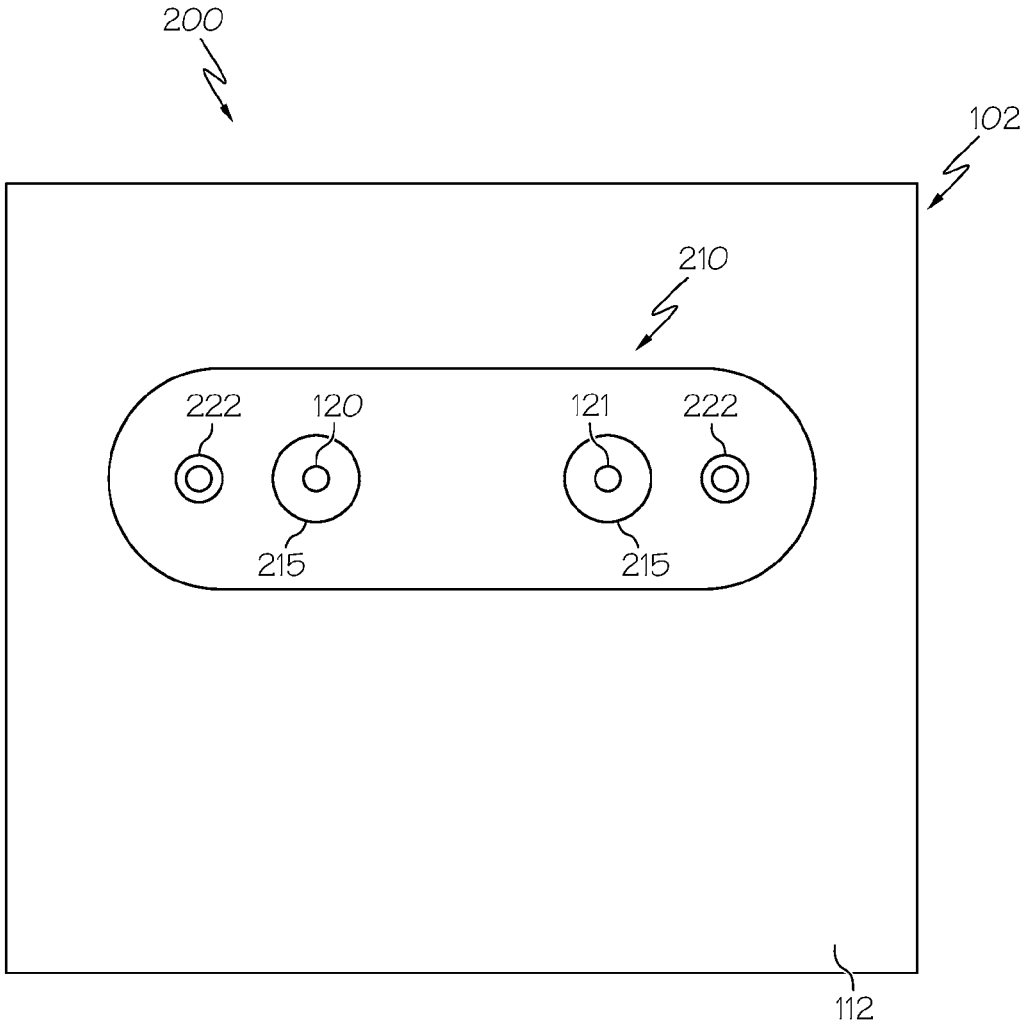
FIG. 9 is a front view of a grain crushing apparatus including a roller carrier assembly according to one or more embodiments of the present disclosure.

Another embodiment of the grain crushing apparatus 200 is depicted in FIGS. 8-15. Referring now to FIG. 8, in this embodiment, the grain crushing apparatus 200 includes mill body 102 having a first sidewall 112 and a second sidewall 113 that are spaced apart from one another in a first direction 80. The spacing between the first sidewall 112 and the second sidewall 113 define a throat dimension 84 of the grain crushing apparatus 100. The mill body 102 also includes endwalls 106 positioned proximate to the ends of the first and second sidewalls 112, 113. The grain crushing apparatus 100 also includes a roller carrier assembly 210 that is selective extendible from the first sidewall 112 and/or the second sidewall 113 in the first direction 80.

Figure 10:
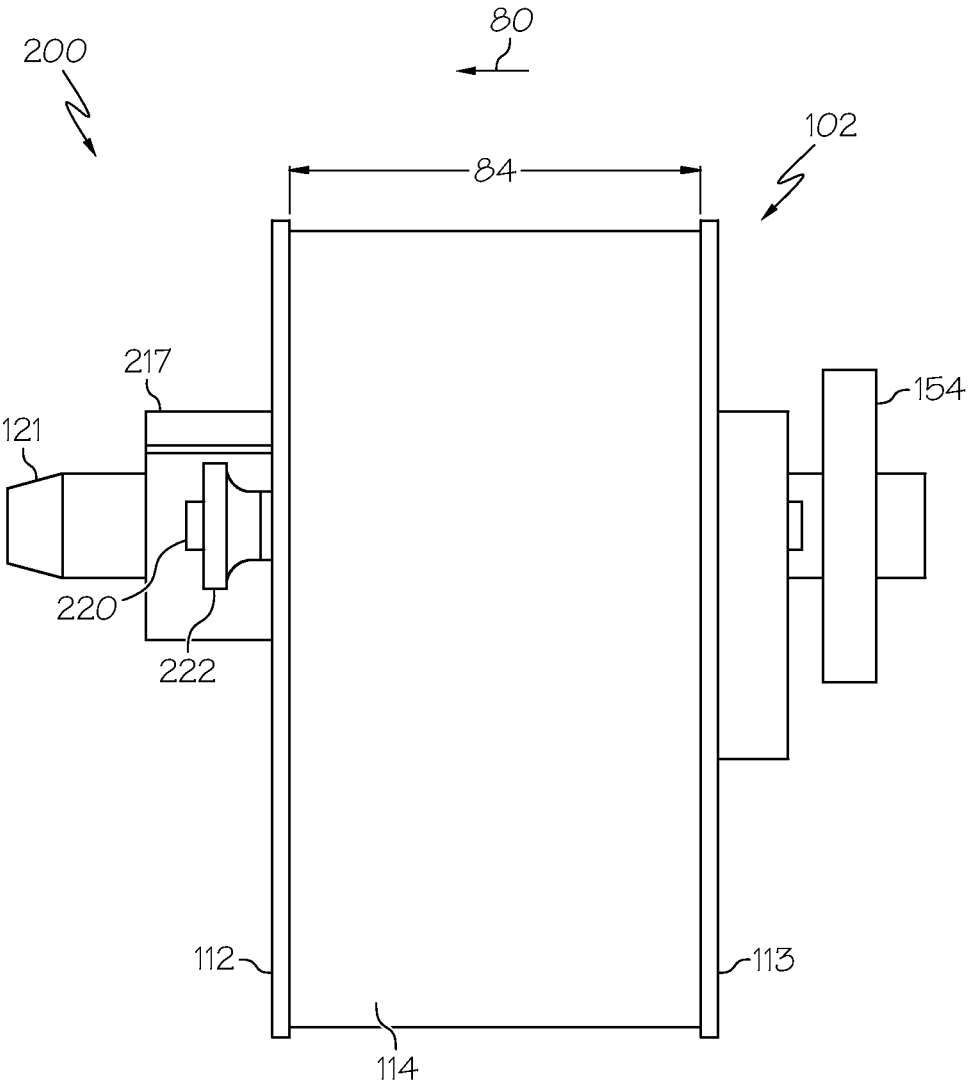
FIG. 10 is side view of a grain crushing apparatus including a roller carrier assembly according to one or more embodiments of the present disclosure.
Figure 11:
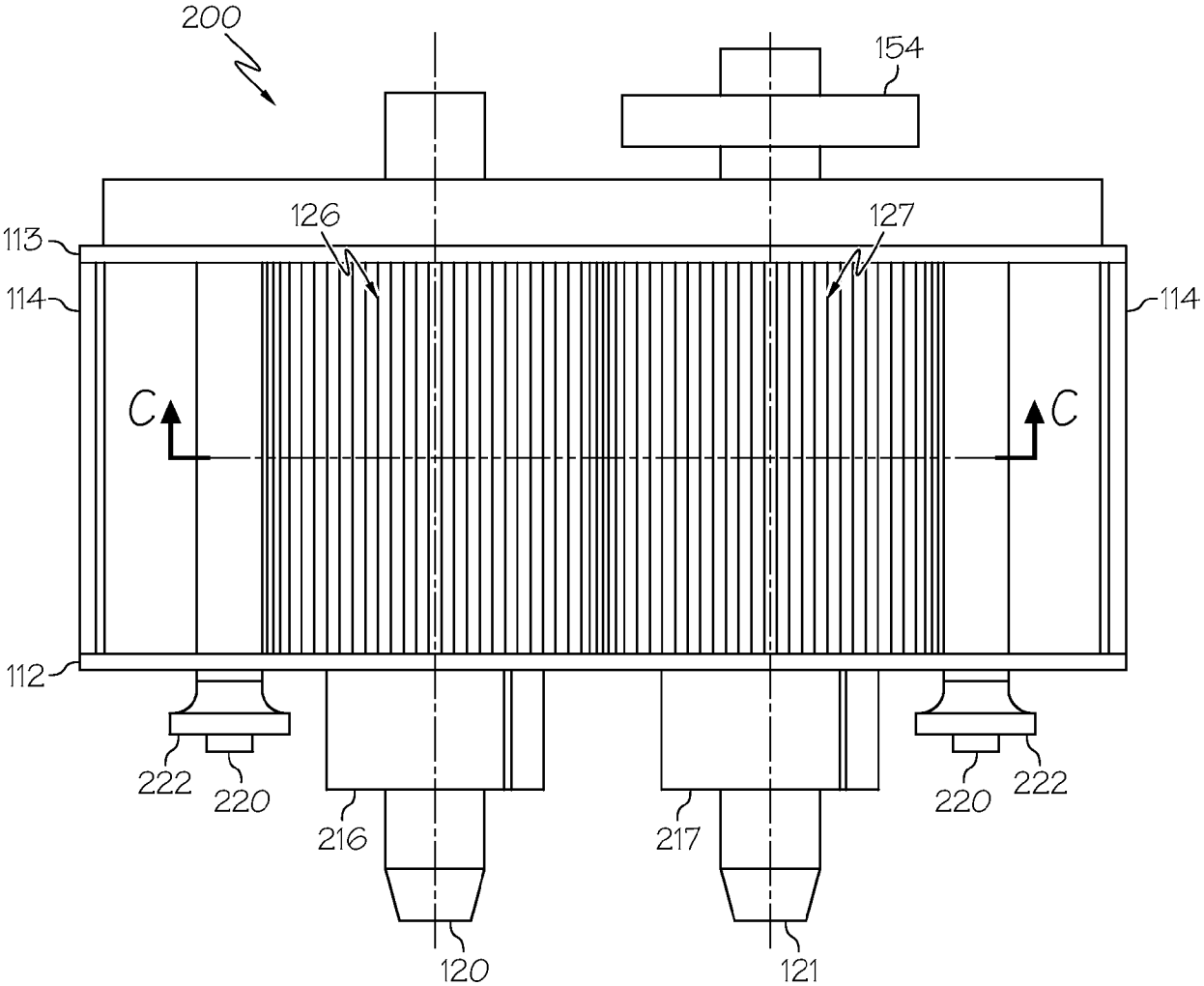
FIG. 11 is a top view of a grain crushing apparatus including a roller carrier assembly according to one or more embodiments of the present disclosure.
Figure 12:
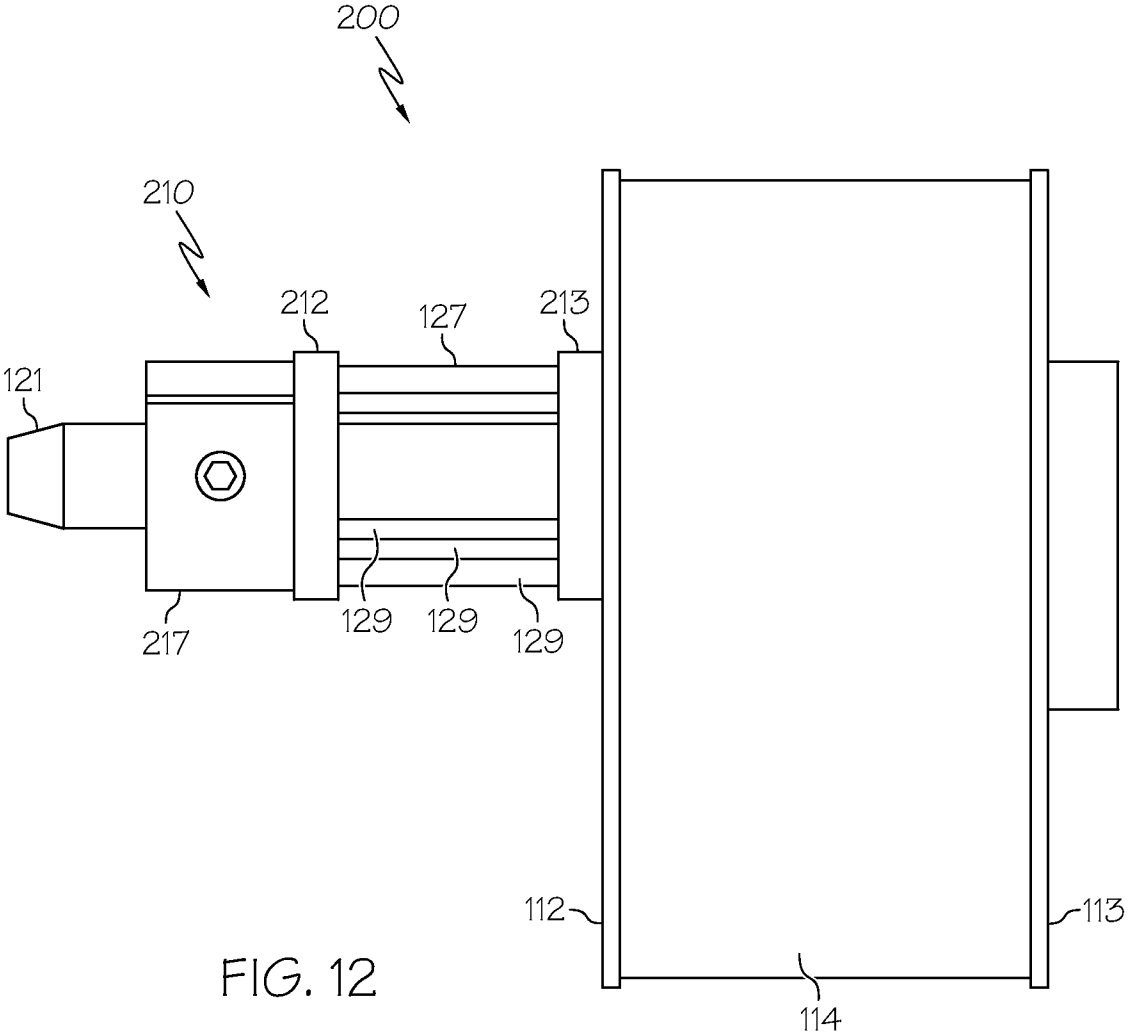
FIG. 12 is a side view of a grain crushing apparatus including a roller carrier assembly positioned in a deployed position according to one or more embodiments of the present disclosure.
Figure 13:
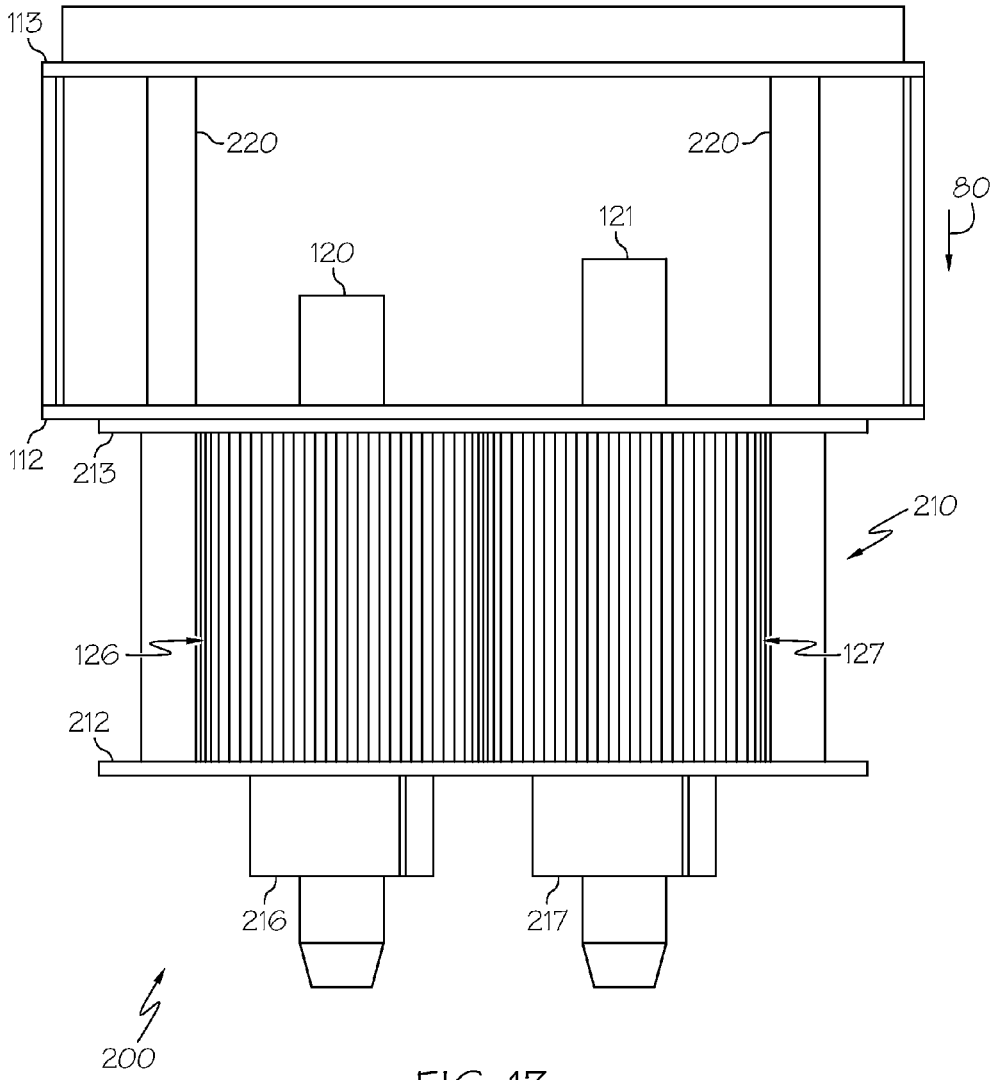
FIG. 13 is a top view of a grain crushing apparatus including a roller carrier assembly positioned in a deployed position according to one or more embodiments of the present disclosure.

In the depicted embodiment, the roller carrier assembly 210 is selectively extendible from the first and second sidewalls 112, 113 of the mill body 102 of the grain crushing apparatus 200. In the embodiment depicted in FIG. 8, the first and second sidewalls 112, 113 each include a clearance opening 214 into which the roller carrier assembly 210 is positioned. The roller carrier assembly 210 may be flush-mounted with the clearance opening 214, such that there is a minimal gap between the first and second mount plates 212, 213 and the first and second sidewalls 112, 113 themselves. The mill body 102 may also include at least one laterally mounting shaft 220 that extends in the first direction 80. The roller carrier assembly 210 includes at least one alignment opening 218 that extends in the first direction 80. The alignment openings 218 of the roller carrier assembly 210 are positioned around the lateral mounting shafts 220. The alignment openings 218 allow the roller carrier assembly 210 to be positioned between a collapsed position (as depicted in FIGS. 10 and 11, and a deployed position, as depicted in FIGS. 12 and 13. For clarity, further detail of the roller carrier assembly 210 will be described in regard to FIGS. 12 and 13 below.

Similar to the embodiment described hereinabove in regard to FIGS. 1-7, the grain crushing apparatus 200 depicted in FIGS. 8-15 includes a drive mechanism rotationally coupled to one of the first support shaft 120 or the second support shaft 121. In the embodiment depicted in FIGS. 10 and 11, a drive sprocket 156 is coupled to one of the first or second support shafts 120, 121. The drive sprocket 156 is coupled to a driving mechanism 90 through the drive belt or chain. The driving mechanism 90 directly controls rotation of the first or second support shaft 120, 121 to which the drive sprocket 156 is coupled, while rotation of the opposite of the first or second support shaft 120, 121 is controlled by the intermeshing of the first and second grain crushing rollers 126, 127, as described hereinabove in regard to FIGS. 1-7.

Referring to FIGS. 10 and 11, the grain crushing apparatus 200 includes a lateral locking mechanism 222 that selectively couples the roller carrier assembly 210 to the lateral mounting shafts 220. In the embodiment depicted in FIGS. 10 and 11, the lateral mounting shafts 220 may include threaded portions (not shown) and the lateral locking mechanism 222 may include a threaded nut. To couple the roller carrier assembly 210 to the lateral mounting shafts 220, and therefore the first and second sidewalls 112, 113 of the mill body 102, the lateral locking mechanism 222 may be tightened against the roller carrier assembly 210 as to tighten against the threaded portion of the lateral mounting shafts 220. To selectively decouple the roller carrier assembly 210 from the mill body 102, the lateral locking mechanisms 222 may be unthreaded from the lateral mounting shafts 220.

With the lateral locking mechanisms 222 disengaged from the lateral mounting shafts 220, the roller carrier assembly 210 may be repositioned from the collapsed position (as depicted in FIGS. 10 and 11) to the deployed position (as depicted in FIGS. 12 and 13). Referring now to FIGS. 12 and 13, the roller carrier assembly 210 includes a first mount plate 212 and a second mount plate 213 that are spaced apart from one another in the first direction 80. The roller carrier assembly 210 also includes a first support shaft 120 and a second support shaft 121 that are positioned transverse to the first and second sidewalls 112, 113 and the first and second mount plate 212, 213 and extend through the first and second sidewalls 112, 113 and the first and second mount plates 212, 213. Each of the first and second support shafts 120, 121 have an axis of rotation 122 around which the first or second support shaft 120, 121 rotates. The first and second mount plate 212, 213 include bearing elements 215 that contact the first or second support shaft 120, 121 and maintain the position of the first and second support shafts 120, 121 relative to the first and second mount plates 212, 213. The first support shaft 120 and the second support shaft 121 are spaced apart from one another a spacing distance 88 in the second direction 82 normal to the first direction 80. In the embodiment depicted in FIGS. 8-15, the axes of rotation 122 of the first and second support shafts 120, 121 are generally perpendicular to the first and second sidewalls 112, 113 of the mill body 102 and the first and second mount plates 212, 213 of the roller carrier assembly 210. The roller carrier assembly 210 further includes a first grain crushing roller 126 coupled to the first support shaft 120 and a second grain crushing roller 127 coupled to the second support shaft 121.

The first support shaft 120 is secured to the first and second mount plates 212, 213 of the roller carrier assembly 210 with a first shaft clamp 216. Similarly, the second support shaft 121 is secured to the first and second mount plates 212, 213 with a second shaft clamp 217. The first and second shaft clamps 216, 217 may be selectively removed from the first or second support shaft 120, 121, thereby disengaging the first or second support shaft 120, 121 from the first and second mount plates 212, 213. By disengaging the first or second shaft clamps 216, 217 from the respective first or second support shaft 120, 121, the respective first or second grain crushing roller 126, 127 may be selectively removed from the roller carrier assembly 210. As such, the first and second grain crushing roller 126 may be interchanged with alternative grain crushing rollers 126, 127, including those having different outer diameters 130 and root diameters 131. By varying the clearance distance between the teeth 129 and the root diameters 131, first and second grain crushing rollers 126, 127 may be fitted within the roller carrier assembly 210 to process grain to the desired consistency.

Figure 14:
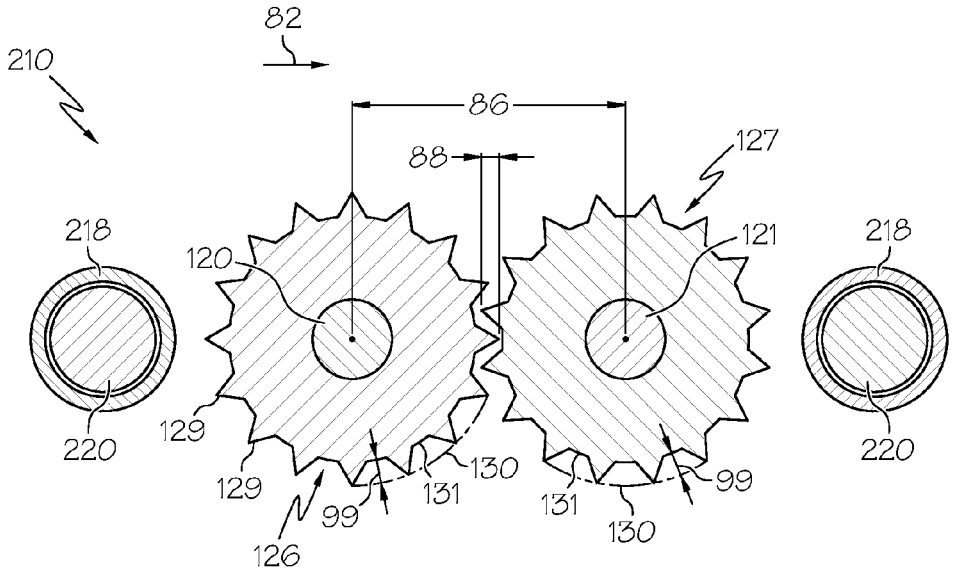
FIG. 14 is a front sectional view of a roller carrier assembly for a grain crushing apparatus according to one or more embodiments of the present disclosure.
Figure 15:
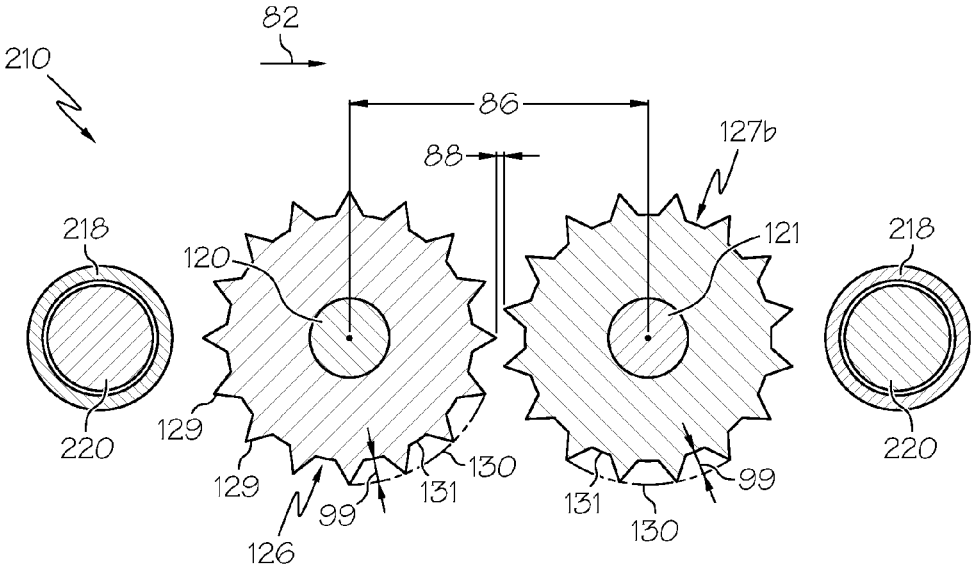
FIG. 15 is a front sectional view of a roller carrier assembly for a grain crushing apparatus according to one or more embodiments of the present disclosure.

Referring now to FIGS. 14 and 15, cross-sectional views of the roller carrier assembly 210 including various sized first and second grain crushing rollers 126, 127 are depicted. Similar to the discussion hereinabove, the first and second grain crushing rollers 126, 127 each teeth 129 that project away from a root diameter 131 towards an outer diameter 130. The distance between the outer diameter 130 of the teeth 129 and the root diameter 131 of the first and second grain crushing rollers 126, 127 is defined as the tooth height 99. The grain crushing rollers 126 are sized and positioned such that the teeth 129 of the corresponding first and second grain crushing rollers 126, 127 intermesh with one another. The first and second grain crushing rollers 126, 127 are spaced apart from one another a spacing distance 88 (i.e., the distance between the respective axis of rotation 122) that provides clearance between teeth 129 of the adjacent first and second grain crushing rollers 126, 127. The relative positioning between the teeth 129 is controlled such that a minimum spacing is maintained between the teeth 129. The first and second grain crushing rollers 126, 127 are maintained at a position spaced apart from one another an overlap distance 88 less than the tooth height 99. The outer diameter 130 of the first and second grain crushing rollers 126, 127 intersect one another, while the root diameters 131 of the first and second grain crushing rollers 126, 127 do not intersect one another.

The first and second grain crushing rollers 126, 127 are installed into the space provided between the first and second mount plates 212, 213 of the roller carrier assembly 210 such that the teeth 129 of the rolls at least partially intermesh with one another. The first and second grain crushing rollers 126, 127 may be spaced apart from one another such that there is not complete engagement of the intermeshed teeth 129 of adjacent first and second grain crushing rollers 126, 127, such that is some clearance between the outer diameter 130 of one of the first and second grain crushing rollers 126, 127 and the root diameter 131 of the opposite of the first and second grain crushing rollers 126, 127. This spacing distance 88 may be set by the combination of the root diameter 131 and outer diameter 130 of each of the first and second grain crushing rollers 126, 127 and the distance between the support shafts 120, 121 about which the first and second grain crushing rollers 126, 127 are adapted to rotate.

In the embodiments depicted in FIGS. 14 and 15, the first and second support shaft 120, 121 are maintained at the same spacing distance 88 relative to one another. To modify the size of particles produced by the grain crushing apparatus 200, spacing between the first and second grain crushing rollers 126, 127 may be modified. To modify spacing between the first and second grain crushing rollers 126, 127, the roller carrier assembly 210 may be disengaged from the first and second sidewalls 112, 113 of the mill body 102 (as shown in FIG. 8) and the alignment openings 218 may be slid over the lateral mounting shafts 220, such that the roller carrier assembly 210 is positioned in the deployed position (as depicted in FIGS. 12 and 13. With the roller carrier assembly 210 positioned in the deployed position, the first and/or second shaft clamps 216, 217 may be removed from the respective first and/or second shaft 120, 121. The first and/or second shaft 120, 121 may be temporarily removed from the roller carrier assembly 210, thereby allowing the first and/or second grain crushing roller 126, 127 to be removed from the roller carrier assembly 210 and a replacement grain crushing roller 126*b*, 127*b* to be fitted in its place. As such, a variety of grain crushing rollers 126, 126*b*, 127, 127*b* having various sized outer diameters 130, root diameters 131, and teeth 129 may be provided such that the grain crushing rollers 126, 127 may be fitted by an end-user of the grain crushing apparatus 200 within the roller carrier assembly 210, as to modify the relative fineness/coarseness of the grain processed by the grain crushing apparatus.

The roller carrier assembly 210 maintains the position of the grain crushing rollers 126, 126*b*, 127, 127*b*, such that the grain crushing rollers 126, 126*b*, 127, 127*b* are at least partially intermeshed with one another, and such that the overlap distance 88 between teeth 129 of adjacent grain crushing rollers (e.g., 126, 127 or 126*b*, 127*b*) is less than the tooth height 99 of any one of the grain crushing rollers 126, 126*b*, 127, 127*b*.

It should now be understood that grain crushing apparatuses according to the present disclosure crush grain between counter-rotating rollers. By rigidly mounting the rollers relative to one another, spacing between adjacent grain crushing rollers can be constrained such that the particulate size of process grain can be precisely controlled. Controlling the particulate size may improve digestion of the grains by humans and/or livestock. Rigid spacing of adjacent grain crushing rollers may be maintained with locator blocks or with a carrier housing, each of which maintain clearance between adjacent grain crushing rollers that is less than the tooth height of any one of the grain crushing rollers.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

What is claimed is:

1. A grain crushing apparatus comprising:

a first sidewall and a second sidewall spaced apart from one another a throat dimension in a first direction;

a first support shaft and a second support shaft positioned transverse to the first sidewall and the second sidewall, the first support shaft and the second support shaft each configured to rotate about an axis of rotation and are positioned a spacing distance from one another in a second direction normal to the first direction;

a first grain crushing roller and a second grain crushing roller, each of the grain crushing rollers comprising a root diameter, an outer diameter, and a plurality of teeth; and a roller carrier assembly that is selectively extendible from the first sidewall and the second sidewall in the first direction, the roller carrier assembly comprising a first mount plate and a second mount plate spaced apart from one another in the first direction, wherein the plurality of teeth extend a tooth height from the root diameter to the outer diameter, wherein the first grain crushing roller is selectively coupled to the first support shaft and the second grain crushing roller is selectively coupled to the second support shaft, wherein the first grain crushing roller and the second grain crushing roller are intermeshed with one another such the first grain crushing roller and the second grain crushing roller are maintained at positions spaced apart from one another in the second direction by an overlap distance less than the tooth height and wherein the first support shaft and the second support shaft extend through the first mount plate and the second mount plate and are rigidly spaced apart from one another in the second direction.

2. The grain crushing apparatus of claim 1, wherein at least one of the first sidewall or the second sidewall comprises a clearance opening and the roller carrier assembly is positioned inside of the clearance opening.

3. The grain crushing apparatus of claim 1 wherein:

the grain crushing apparatus further comprises at least one lateral mounting shaft extending in the first direction;

the roller carrier assembly further comprises an alignment opening extending in the first direction; and the alignment opening of the roller carrier assembly is positioned around the at least one lateral mounting shaft such that the roller carrier assembly is selectively extendible from the first sidewall and the second sidewall along the at least one lateral mounting shaft.

4. The grain crushing apparatus of claim 3 further comprising a lateral locking mechanism that selectively couples the roller carrier assembly to the at least one lateral mounting shaft in the first direction.

5. The grain crushing apparatus of claim 1, wherein the roller carrier assembly further comprises bearing elements positioned between the first and second mount plates and the first and second support shafts.

6. The grain crushing apparatus of claim 1, further comprising a first shaft clamp positioned along the first support shaft and selectively coupling the first support shaft to the first mount plate and the second mount plate.

7. The grain crushing apparatus of claim 1, further comprising a drive mechanism rotationally coupled to one of the first support shaft or the second support shaft, wherein the intermeshing of the first grain crushing roller and the second grain crushing roller drives rotation of the opposite of the first support shaft or the second support shaft that is rotationally coupled to the drive mechanism.

8. The grain crushing apparatus of claim 1 further comprising a first guide plate and a second guide plate that are coupled to the first sidewall and the second sidewall and direct grain towards the first grain crushing roller and the second grain crushing roller, which are intermeshed with one another.

9. A grain crushing apparatus comprising:

a first sidewall and a second sidewall spaced apart from one another a throat dimension in a first direction;

a first support shaft and a second support shaft positioned transverse to the first sidewall and the second sidewall, the first support shaft and the second support shaft each configured to rotate about an axis of rotation and are positioned a spacing distance from one another in a second direction normal to the first direction;

a first grain crushing roller and a second grain crushing roller, each of the grain crushing rollers comprising a root diameter, an outer diameter, and a plurality of teeth, wherein the plurality of teeth extend a tooth height from the root diameter to the outer diameter;

a first locator block selectively coupled to the first sidewall and a second locator block selectively coupled to the second sidewall, the first locator block and the second locator block each comprising a bore diameter through which one of the first support shaft or the second support shaft passes wherein the plurality of teeth extend a tooth height from the root diameter to the outer diameter, wherein the first grain crushing roller is selectively coupled to the first support shaft and the second grain crushing roller is selectively coupled to the second support shaft, and wherein the first grain crushing roller and the second grain crushing roller are intermeshed with one another such the first grain crushing roller and the second grain crushing roller are maintained at positions spaced apart from one another in the second direction by an overlap distance less than the tooth height.

10. The grain crushing apparatus of claim 9, wherein:

the first sidewall comprises a first cavity into which the first locator block is positioned, the first cavity comprising a first datum face; and the second sidewall comprises a second cavity into which the second locator block is positioned, the second cavity comprising a second datum face.

11. The grain crushing apparatus of claim 10, wherein a relative position of the bore diameters of the first and second locator blocks to the first datum face of the first cavity and the second datum face of the second cavity controls the spacing distance between the first support shaft and the second support shaft.

12. The grain crushing apparatus of claim 9, further comprising a first shaft clamp positioned along the first support shaft and selectively coupling the first support shaft to the first locator block and the second locator block.

13. A grain crushing apparatus comprising:

a mill body comprising a first sidewall and a second sidewall spaced apart from one another a throat dimension in a first direction, wherein at least one of the first sidewall or the second sidewall comprises a clearance opening;

a roller carrier assembly that is selectively extendible from the clearance opening in the mill body, the roller carrier assembly comprising a first mount plate and a second mount plate spaced apart from one another in the first direction, a first support shaft and a second support shaft positioned transverse to the first mount plate and the second mount plate, the first support shaft and the second support shaft each configured to rotate about an axis of rotation and are spaced a spacing distance from one another, and a first grain crushing roller and a second grain crushing roller, each of the grain crushing rollers comprising a root diameter, an outer diameter, and a plurality of teeth, wherein the plurality of teeth extend a tooth height from the root diameter to the outer diameter, wherein the first grain crushing roller is coupled to the first support shaft and the second grain crushing roller is coupled to the second support shaft, and the first grain crushing roller and the second grain crushing roller are intermeshed with one another such that the first grain crushing roller and the second grain crushing roller are maintained at a position spaced apart from one another by an overlap distance less than the tooth height.

14. The grain crushing apparatus of claim 13, wherein:

the mill body further comprises at least one lateral mounting shaft extending in the first direction;

the roller carrier assembly further comprises an alignment opening extending in the first direction; and the alignment opening of the roller carrier assembly is positioned around the at least one lateral mounting shaft such that the roller carrier assembly is selectively extendible from the first sidewall and the second sidewall along the at least one lateral mounting shaft.

15. The grain crushing apparatus of claim 14 further comprising a lateral locking mechanism that selectively couples the roller carrier assembly to the at least one lateral mounting shaft in the first direction.

16. The grain crushing apparatus of claim 13, further comprising a first shaft clamp positioned along the first support shaft and selectively coupling the first support shaft to the first mount plate and the second mount plate.

17. A grain crushing apparatus kit comprising:

a mill body comprising a first sidewall and a second sidewall spaced apart from one another a throat dimension in a first direction;

a roller carrier assembly that is selectively extendible from the mill body, the roller carrier assembly comprising a first mount plate and a second mount plate spaced apart from another in the first direction, a first support shaft and a second support shaft positioned transverse to the first mount plate and the second mount plate, the first support shaft and the second support shaft each configured to rotate about an axis of rotation and are spaced a spacing distance from one another; and and plurality of grain crushing rollers each comprising a root diameter, an outer diameter, and a plurality of teeth, wherein the plurality of teeth extend a tooth height from the root diameter to the outer diameter, wherein a first grain crushing roller is adapted to be selectively coupled to the first support shaft and a second grain crushing roller is adapted to be selectively coupled to the second support shaft, and the first grain crushing roller and the second grain crushing roller are intermeshed with one another such that the first grain crushing roller and the second grain crushing roller are maintained at a position spaced apart from one another by an overlap distance less than the tooth height;

wherein at least two of the grain crushing rollers have outer diameters different from one another such that the overlap distance between the first grain crushing roller and the second grain crushing roller is adjustable.

18. The grain crushing apparatus kit of claim 17, wherein:

the mill body further comprises at least one lateral mounting shaft extending in the first direction;

the roller carrier assembly further comprises an alignment opening extending in the first direction; and the alignment opening of the roller carrier assembly is positioned around the at least one lateral mounting shaft such that the roller carrier assembly is selectively extendible from the first sidewall and the second sidewall along the at least one lateral mounting shaft.

19. The grain crushing apparatus kit of claim 18, further comprising a lateral locking mechanism that selectively couples the roller carrier assembly to the at least one lateral mounting shaft in the first direction.

* * * * *